US005720119A

United States Patent [19]

Benoit

[11] Patent Number: 5,720,119

[45] Date of Patent: Feb. 24, 1998

[54] SPORTS BOOT

[75] Inventor: Louis Benoit, La Balme de Sillingy, France

[73] Assignee: Salomon, S.A., Metz-Tessy, France

[21] Appl. No.: 570,993

[22] Filed: Dec. 12, 1995

[30] Foreign Application Priority Data

Dec. 23, 1994 [FR] France ..... 94 15820

[51] Int. Cl.[6] ..... A43B 5/04; A43B 5/16

[52] U.S. Cl. ..... 36/117.1; 36/117.7; 36/118.1

[58] Field of Search ..... 36/50.5, 117.7, 36/118.2, 118.1, 118.8, 118.9, 117.1

[56] References Cited

U.S. PATENT DOCUMENTS

| | | | |
|---|---|---|---|
| 3,886,673 | 6/1975 | Check et al. | 36/118.8 |
| 4,711,042 | 12/1987 | Morell et al. | 36/50 |
| 4,908,965 | 3/1990 | Iwama | 36/50.5 |
| 5,191,728 | 3/1993 | Paris et al. | 36/117.7 |
| 5,379,531 | 1/1995 | Iwama | 36/50.5 |
| 5,381,612 | 1/1995 | Paris | 36/117 |
| 5,517,771 | 5/1996 | Paris et al. | 36/118.2 |

FOREIGN PATENT DOCUMENTS

| | | | |
|---|---|---|---|
| 2652241 | 3/1991 | France . | |
| 1963342 | 6/1971 | Germany . | |
| 4006892A | 9/1990 | Germany | 36/118.8 |

*Primary Examiner*—Paul T. Sewell
*Assistant Examiner*—Anthony Stashick
*Attorney, Agent, or Firm*—Greenblum & Bernstein, P.L.C.

[57] ABSTRACT

The shoe is of the type constituted by a shell base adapted to receive the foot of the user and a upper-collar in two portions journaled on the shell base, and including elements for mutually bringing together and latching the two portions of the upper in the tightening position around the lower leg. The invention includes elements for supporting a portion of the upper with respect to the shell base, elements associated with the portion of the upper and controlling the relative displacement between the portion of the upper and the shell base, second element associated with the second portion of the upper and controlling the relative displacement of the portion of the upper with respect to the other portion of the upper, and the tightening and latching of the second element and the support of the portion with respect to the shell base are subjected to the tightening and latching of the element, in a manner as to preserve a substantially constant angle of inclination of the axis of the upper-collar whatever the size of the leg.

16 Claims, 2 Drawing Sheets

SPORTS BOOT

BACKGROUND OF THE INVENTION

1. Field of the Invention

The present invention is directed to a shoe adapted to for gliding sports such as alpine skiing, surfing, in-line skating, while assuring the retention of the leg and the linkage between the gliding element and the foot of the user by means of a structure of the shell type and a rigid or semi-rigid upper.

2. Background Materials and Related Information

In such shoes, and more particularly in alpine ski boots, there are three major families based upon the method opening and putting on of the upper.

The first major family is that of boots referred to as front entry boots which comprise a shell provided on the front portion with a longitudinal slot, allowing for the introduction of the foot and of the leg, and whose edges or flaps overlap and are provided with closure and tightening means positioned on both sides of the slot. Such a shell is likewise referred to as a shell of variable volume by virtue of the possibility of adapting its volume to that of the foot and of the leg by action on the closure and tightening means.

In this type of boot, the foot and the leg are pressed by the flaps of the shell against the sole and the rear rigid portion of the boot.

The leg is then supported towards the rear and it is the rear portion of the boot which defines the angle of inclination of the axis of the leg with respect to the gliding element.

The second major family is that of boots referred to as rear entry boots whose shell comprises a front rigid and substantially non-deformable portion, referred to as a shell of constant volume, and a rear spoiler journalled on the base of the shell and comprising closure and tightening means on the front portion of the shell.

The opening of the rear spoiler allows for the introduction of the foot into the boot from the rear. In this type of boot, the leg is pressed by means of the rear spoiler against the front portion of the shell. The leg is referred to as being supported towards the front and it is the front portion of the shell which defines the angle of inclination of the leg with respect to the gliding element.

There exists a third major family of boots referred to as hybrids or "mid" boots comprising an upper-collar constituted by a front spoiler and a rear spoiler journaled on the shell base, and which can open "as a tulip" for a central insertion of the foot within the boot.

In these boots, blocking means of the abutment type, for example, are associated with one of the spoilers, generally the rear spoiler, to maintain it in a predetermined reference position, the other spoiler being closed and latched on the spoiler to hold the leg. One thus obtains, as the case may be, a boot which is directed towards the front or towards the rear of the leg.

In all of the above boots, the tightening and maintenance of the leg within the boot always occurs by pushing it against a front or rear reference surface connected to the boot, and whose angle of inclination with respect to the plane of the shell base is determined by construction, this angle being generally referred to as the advance angle.

Yet, such an advance angle does not necessarily correspond to the skiing, surfing or skating position, desired by the wearer who must, therefore, adapt the boot, unless means for adjusting the advance angle are provided. Even with such adjustment means, the "real" advance angle of the leg or tibia of the wearer with respect to his foot does not necessarily correspond to the "contemplated" advance angle on the boot.

This is particularly true depending upon the morphology of the wearers. Thus, whether the reference plane of the advance angle is frontward or rearward, a wearer of the boot having a large calf will have his leg inclined more towards the front, and thus "more advanced" than a wearer of the boot having a small calf, in the case of a front entry boot. On the contrary, in a rear entry boot, a wearer having a large calf will have his leg more inclined towards the rear and thus "less advanced" than a wearer of a boot having a small calf.

The boots of the known prior art do not make it really possible to have a "fixed" advance angle regardless of the morphology of the wearer.

It is likewise known, by German Application No DE 19 63 342, to obtain a ski boot in the form of a shell comprising two front and rear portions of the upper journaled on the shell base, these two portions being able to come together or "open" in the manner of a tulip and to be tightened around the leg of the skier by means of a peripheral strap.

Such a boot has the advantage of "adapting itself" through its two portions of the upper to the leg of skier and not the opposite. However, such a boot has never really been satisfactory because it did not allow for any rearward support or satisfactory support.

SUMMARY OF THE INVENTION

The object of the present invention is to overcome the above disadvantages and to provide an improved design of a shell type boot offering a good support for the leg of the wearer and a "fixed" advance angle, regardless of the morphology of the wearer, and without imposing an adaptation of the wearer to the boot.

This object is achieved in the boot according to the invention, which is of the type that includes a shell base adapted to receive the foot of the user and a upper-collar in two portions journaled on the shell base, the boot including an arrangement for bringing together and latching the two portions while being tightened around the lower leg, by virtue of the fact that it includes, in combination, a support for a first portion of the upper with respect to the shell base which is variable as a function of the degree of opening/closing of the first portion of the upper; a first tightening and latching system associated with the first portion of the upper and controlling the relative displacement between the portion of the upper and the shell base; a second tightening and latching system associated with the second portion of the upper and controlling the relative displacement of the second portion of the upper with respect to the first portion of the upper; wherein the first and second tightening and latching system and the support of the first portion of the upper with respect to the shell base are subjected to the tightening and to the latching of the first tightening and latching system, so as to obtain an angle of inclination of the axis of the upper-collar which is substantially constant regardless of the size of the leg.

Such a construction allows for an adaptation of the boot to the leg, and not the opposite as is presently the case, because it is the portions of the upper which close on the leg by approaching one another.

Furthermore, the construction envisioned makes it possible to preserve a constant advance angle whatever the dimensions of the lower leg and in particular of the tibia/calf, because this advance angle corresponds, in fact, to the angle of inclination formed by the longitudinal axis of the upper-collar which remains constant.

BRIEF DESCRIPTION OF DRAWINGS

In any event, the invention will better understood and other characteristics thereof will become clear from the description which follows with reference to the annexed schematic drawing, showing, in a non-limiting way, an example to application to an alpine ski boot, in which.

DETAILED DESCRIPTION

Figure 1:
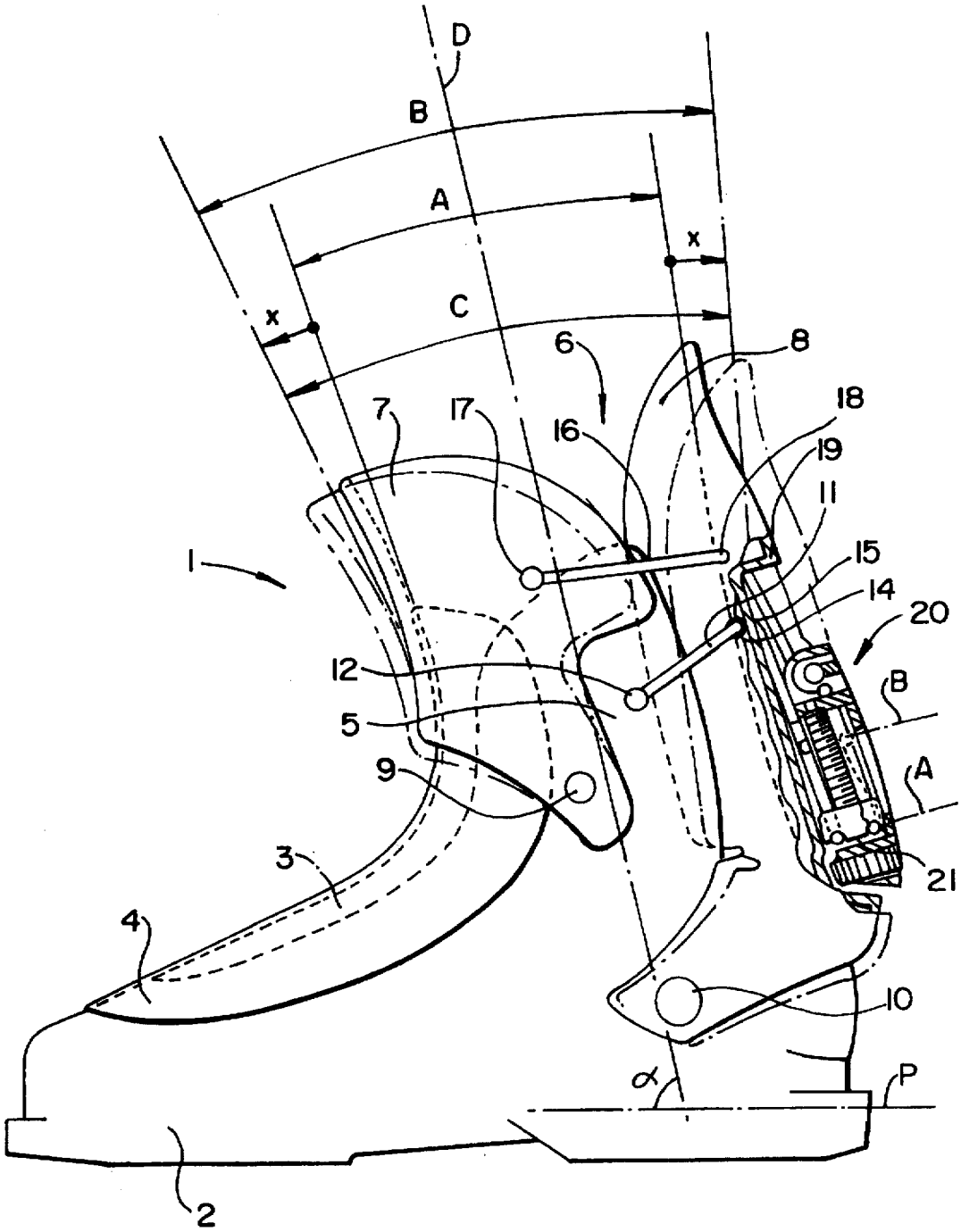
FIG. 1 is a side view in partial cross-section of a boot according to the invention showing a plurality of opening adjustment positions for its upper-collar.
Figure 3:
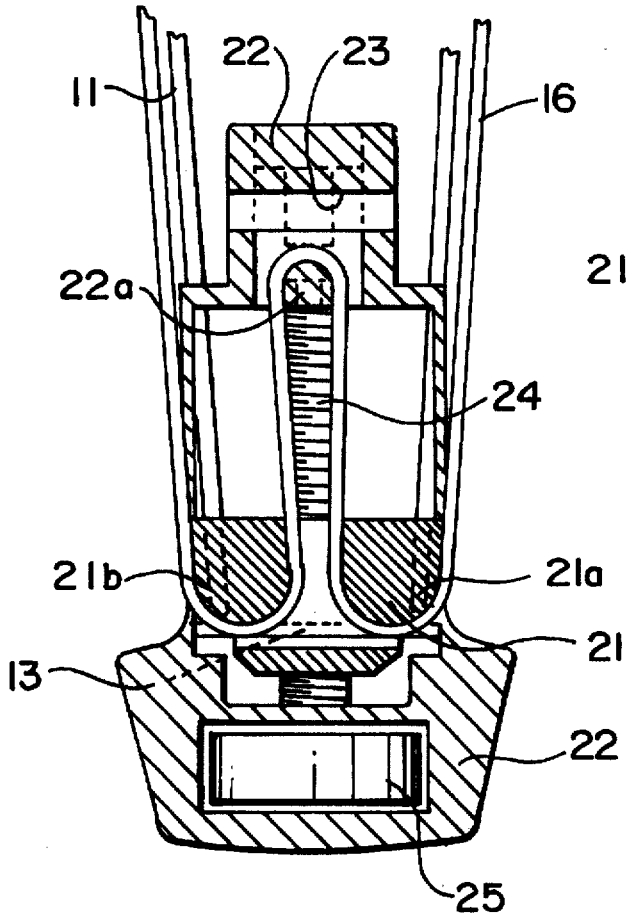
FIG. 3 is a cross-sectional view along to III—III of FIG. 2.
Figure 2:
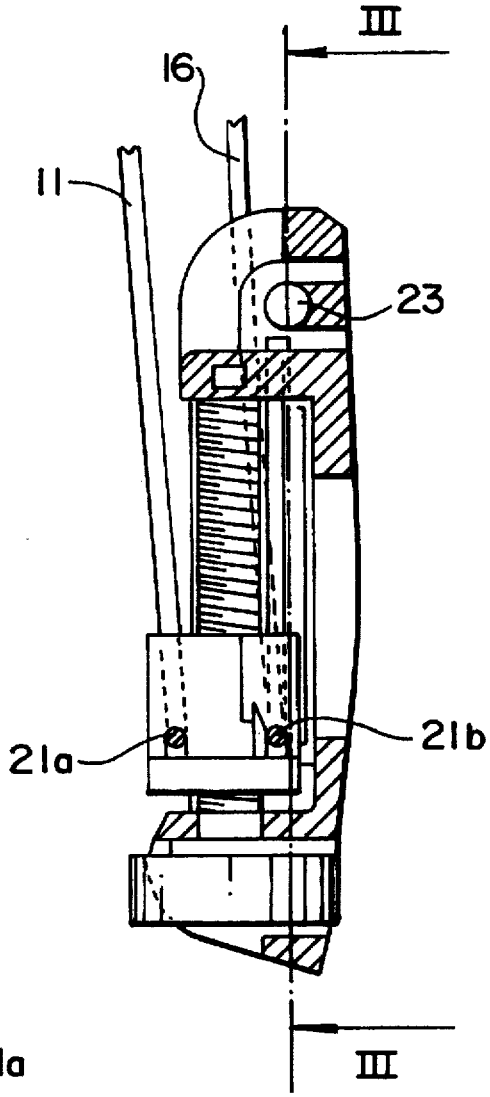
FIG. 2 is, on an enlarged scale, a longitudinal cross-sectional view of the latching system.

FIG. 1 shows the invention applied to a ski boot (1). This boot is constituted essentially of a shell base (2) made of rigid synthetic material, and provided with an opening (3) on the front, covered by a spoiler (4), and on each of the sides with a vertical extension constituting a lateral wing (5), as well as an upper-collar (6) in two portions, viz., a front portion (7) and a rear portion (8) each journaled on the shell base along a substantially transversely extending journal or journal element (9) and (10), respectively, and being able to be brought together or spaced from one another by means of a common tightening and latching system or lever/stretcher (20). The position of the front portion (7) and rear portion (8) determines an advance angle "α" of the boot, that is, the angle of inclination of the axis "D" of the upper with respect to the plane "P" of the shell base.

Shell base (2) is adapted to receive the foot and can comprise, in a manner known in itself, an internal tightening system of the foot (not shown in the drawing).

This shell base (2) can likewise be provided with a variable volume with a slot, two flaps and a tightening/latching system, or, on the contrary, can be of fixed volume as in the conventional rear entry boots.

Upper-collar (6), (7), (8) is adapted to receive and tighten around the lower leg of the user by coming together of the two portions (7) and (8) of the upper.

The rear portion (8) of the upper is connected to the shell base, in addition to its journal (10), by a non-extendable, flexible connection or cable (11) anchored on each end, for example, by riveting (12), forming an anchoring point on each of the wings (5) of the shell base.

This cable (11) thus forms a buckle whose median portion (13) is engaged on a movable nut (21) of the lever/stretcher (20) as will be seen below.

Each strand of cable (11) is furthermore guided and returned on rear portion (8) of the upper through two slots (14-15) positioned respectively on the side and at the rear of this portion (8) of the upper.

Of course, cable (11) can likewise be replaced by two cables which are each anchored on the shell base and on the movable nut (21) of the lever/stretcher (20).

In a similar manner, the front portion (7)of the upper is connected to the rear portion (8) of the upper by a cable (16) anchored by a rivet (17), or other similar linkage, on each of the sides of this front portion (7) of the upper, and whose median portion is likewise engaged on the lever-stretcher (20) and its movable nut (21).

As with cable (11), each strand of cable (16) is guided and returned on the rear portion (8) of the upper-collar through two slots (18, 19) positioned respectively on the side and on the rear of this portion (8) of the upper.

Cable (16) can likewise be replaced by two cables each anchored on the portion (7) of the upper and on the lever-stretcher (20).

The lever-stretcher (20) is constituted essentially by a body (22) journaled by means of a transverse axis (23) on the rear of the rear portion (8) of the upper.

An endless screw (24), connected to an activation wheel (25) is, in a known manner, freely mounted in rotation but blocked in the axial direction on the body (22) of the lever.

This screw (24) carries the nut (21) which is, in a manner known in itself, blocked but axially movable in rotation. Thus, a rotation of the screw (24) by means of the wheel (25) causes the displacement of the nut (21) along this screw, and consequently the tightening or loosening of cables (11) and (16) engaged on this nut.

Cable (11) is slidably mounted in a semi-circular groove (21*a*) of nut (21). In a similar manner, cable (16) is wound around two semi-circular projections (21*b*) of nut (21). Furthermore, this cable (16) passes on a semi-circular guide or projection (22*a*) provided on body (22), affixed with respect to the nut, of the lever-stretcher (20).

The fact that the two cables (11) and (16) are mounted on the same nut (21) of the lever-stretcher makes it possible to have a displacement and simultaneous control of the tension of these two cables during the activation of the wheel (25) on the closure of the lever, this closure causing by a knuckle joint effect known in itself and not shown below, the blockage of the lever and the tensioning of the cables (11) and (16).

Furthermore, the block and tackle of cable (16), achieved by means of two projections (21*b*) of the nut and of the projection (22*a*) or fixed part of body (22) of the lever, makes it possible, with respect to the cable (11), to multiply by two the length of cable (16) released, or depending upon the case, tightened during activation of wheel (25).

Thus, the closure of lever-stretcher (20) will always control a displacement of the cable (16) which is double with respect to that of cable (11).

Consequently, and as shown in FIG. 1, after adequate adjustment of wheel (25) from a position "A" to "B", the closure of lever-stretcher (20) will always cause a displacement "2x" (see arrow C in FIG. 1) for a displacement "x" of the rear portion (8) of the upper, from a position "A" to a position "B", in the same release or tightening direction, of the front portion (7) of the upper with respect to this rear portion (8) of the upper, to go from the same position "A" to the position "B", this double displacement compensating for the displacement made by the rear portion (8) of the upper.

It is thus guaranteed that beginning at a given position "A" the displacements of the two portions (7) and (8) of the upper, on both sides of the median axis "B" of the upper, are symmetrically equal.

As these displacements are symmetrical, it is guaranteed that the advance angle "α" constituted by the angle of inclination of the axis "D" of the upper with respect to the plane "P" of the shell base, remains constant regardless of the dimensions of the lower leg to be accommodated. In fact, the support of the portion (8) of the upper on the shell base, which is defined by the length of cable (11) between the anchoring point (12) and the first return, formed by slot (14), is here variable as a function of the adjustment but is subjected to this adjustment in a manner so as to preserve a constant advance angle "α" of the assembly of the upper whatever the size of the leg. One thus obtains a boot which adapts itself to the leg of the skier and not the opposite.

Depending upon the case and the supposed morphology of the users, or depending on the type of use, surfing, in-line skating, . . . , desired for the boot, the displacement ratio of the two portions (7) and (8) of the upper can be modified and go for example from 2/1 to 3/2.

It likewise could be possible to modify the advance angle. This advance angle "α" is, as previously indicated, defined by the length of cable (11) between the anchoring point (12) and the first return (14). It will suffice to modify the anchoring point (12) to obtain different advance angles "α" of the assembly of the upper. This adjustment of the anchoring points (12) can be obtained for example and in a known manner by a projection system cooperating with loop of cable (11) (not shown in the drawing).

It can likewise be provided to modify the anchoring of the cable (11) within the lever-stretcher.

Furthermore, it will be noted that the direct linkage of the cable (11) to the shell base (2) makes it possible to have a very precise support of the rear flap portion with respect to this shell base, and makes it thus possible to obtain a rear support, that is, support of the rear flap (8) against movement in a rearward direction with respect to the shell base.

Depending upon the case and the type of sport envisioned, it could be desirable, on the contrary, to support the front portion of the upper with respect to the shell base in a manner so as to obtain a front support rather than a rear support.

The support of the rear portion (8) of the upper, or the rear support, can likewise be obtained by any other manner known in itself, for example by means of an adjustable rear abutment cooperating with the rear portion of the upper.

The advantage of utilizing cable (11) to achieve this rear support is that the cable satisfies two functions and that the subjection of the support to the adjustment is obtained directly, resulting in a simplification of the construction and a reduction of the manufacturing costs.

All of the conventional means of flexion or stiffness adjustment can likewise be provided.

Of course, the present invention is not limited only to the embodiment described here by way of non-limiting example, but encompasses all of the embodiments.

Thus, the present invention can be applied to a boot used in a sport other than an alpine skiing, for example a surfing boot, in-line skating boots, etc. It is furthermore not limited to a boot of the shell type, i.e., comprising a shell base completely surrounding the foot, it being essential that the shell base comprise the rigid portions necessary to the journaling of the portions of the upper.

The journals of the portions of the upper can likewise by positioned variously as a function of the results desired without going beyond the scope of the present invention.

The instant application is based upon French patent application 9415820, filed Dec. 23, 1994, the disclosure of which is expressed and incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

I claim:

1. A boot comprising:

a shell base adapted to receive a foot of a user;

an upper/collar comprising a first portion and a second portion, a pivot connection between said first portion to said shell base and a pivot connection between said second portion to said shell base;

an assembly to move both of said first portion and second portion together and to fix said first portion and said second portion in a tightened position around a leg of the user in a predetermined advance angle of said upper/collar, said assembly comprising:

an arrangement to support said first portion of said upper/collar in a support position with respect to said shell base;

a first tightening and latching system to tighten and latch said first portion of said upper/collar in a predetermined position with respect to said shell base to control relative displacement of said first portion with respect to said shell base, said first tightening and latching system comprises:

at least a first inextendible flexible linkage anchored on the shell base and on said first portion of said upper/collar; and a lever/stretcher mounted for movement to act on said first flexible linkage selectively to bring said first portion of said upper/collar toward said shell base or to space said first portion of said upper/collar from said shell base, said lever/stretcher being affixed to said first portion of said upper/collar and comprises the anchoring of said first flexible linkage on said first portion of said upper/collar;

a second tightening and latching system to tighten and latch said second portion of said upper/collar in a predetermined position with respect to said first portion to control relative displacement of said second portion with respect to said first portion, said second tightening and latching system comprises:

a second inextendible flexible linkage anchored on said second portion of said upper/collar; and said lever/stretcher;

said lever/stretcher being connected to each of said first flexible linkage and said second flexible linkage to control displacement of said second flexible linkage simultaneously with displacement of said first flexible linkage;

wherein said support position of said first portion of said upper/collar and said predetermined position of said second portion of said upper/collar are set by said first tightening and latching system to thereby maintain said predetermined advance angle of said upper/collar independent of a size of the user's leg; and wherein said assembly to move both of said first portion and said second portion together comprises an assembly to simultaneously displace said second flexible linkage an amount twice an amount said first flexible linkage is displaced.

2. A boot according to claim 1, wherein:

said arrangement to support said first portion of said upper/collar in a support position with respect to said shell base is operatively connected with and is controlled by said first tightening and latching system.

3. A boot according to claim 2, wherein:

said arrangement to support said first portion of said upper/collar in a support position with respect to said shell base includes means for adjusting said support position.

4. A boot according to claim 1, further comprising:

means for modifying a position of at least one anchoring point of said first flexible linkage.

5. A boot according to claim 1, wherein:

said means for simultaneously displacing said second flexible linkage an amount twice an amount said first flexible linkage is displaced comprises a screw and nut mechanism, said nut being mounted for movement along said screw, said first flexible linkage and said second flexible linkage being connected to said nut to control the displacement of said first and second flexible linkages, said lever/stretcher having a guide over which said second flexible linkage extends to provide a double winding of said second flexible linkage to effect said displacing of said second flexible linkage an amount twice an amount said first flexible linkage is displaced.

6. A boot according to claim 1, wherein:

said first portion of said upper/collar is a rear portion of said upper/collar.

7. A boot according to claim 1, wherein:

said first portion of said upper/collar is a front portion of said upper/collar.

8. A boot comprising:

a shell base adapted to receive a foot of a user;

an upper comprising a first portion and a second portion, said first and second portions of said upper being pivotally connected to said shell base for movement selectively together or apart; and means for simultaneously effecting movement of both of said first portion and said second portion together and for effecting movement of said first portion and second portion apart, to provide for a spacing between said first portion and second portion to accommodate a range of leg sizes, and for fixing said first portion and second portion in a predetermined position defining a predetermined advance angle of said upper, said means further comprising means for maintaining said advance angle of said upper during said moving of said first portion and said second portion.

9. A boot according to claim 8, wherein:

said means for maintaining said advance angle comprises means for fixing said upper in support with respect to said shell base.

10. A boot according to claim 8, wherein:

said means for simultaneously effecting movement comprises means for simultaneously effecting a continuously variable adjustment of said spacing between said first portion and said second portion.

11. A boot comprising:

a shell base adapted to receive a foot of a user;

an upper comprising a first portion and a second portion, said first and second portions of said upper being pivotally connected to said shell base;

means for simultaneously moving both of said first portion and said second portion together and for fixing said first portion and said second portion in a position defining a predetermined advance angle of said upper, whereby said upper extends along an axis of inclination, said means further comprising means for simultaneously moving each of said first portion and said second portion, with respect to said axis of inclination, an equal distance;

said means for simultaneously moving and fixing said first and second portions further comprises:

means for continuous adjustment of a spacing between said first portion and said second portion to accommodate a range of sizes of legs positioned between said first and second portions of said upper, while maintaining said predetermined advance angle of said upper, independent of any particular size of leg.

12. A boot according to claim 11, wherein:

said means comprise means for fixing said upper in support against movement with respect to said shell base in a predetermined direction.

13. A boot comprising:

a shell base adapted to receive a foot of a user;

an upper comprising a first portion and a second portion, said first and second portions of said upper being pivotally connected to said shell base;

means for simultaneously moving both of said first portion and said second portion together and for fixing said first portion and said second portion in a position defining a predetermined advance angle of said upper, whereby said upper extends along an axis of inclination;

said means for simultaneously moving and for fixing said first and second portions further comprises means for latching and tightening said first and second portions of said upper in said position defining a predetermined advance angle of said upper, said means for latching and tightening comprising:

a lever mounted for movement on said first portion of said upper;

an anchoring element mounted on said lever and means for moving said anchoring element to reposition said anchoring element on said lever;

a first flexible linkage extending from an attachment to said shell base and to said anchoring element of said lever;

a second flexible linkage extending from an attachment to said second portion of said upper and to said anchoring element of said lever.

14. A boot according to claim 13, wherein:

said means for moving said anchoring element on said lever comprises means for adjusting an effective length of said first flexible linkage extending between said shell base and said anchoring element and for adjusting an effective length of said second flexible linkage extending between said second portion of said upper and said anchoring element.

15. A boot according to claim 14, wherein:

said means for adjusting effective lengths of said first and second flexible linkages comprises means for simultaneously displacing said second flexible linkage an amount twice an amount said first flexible linkage is displaced.

16. A boot according to claim 13, wherein:

said first portion of said upper is a rear portion and said second portion of said upper is a front portion.

* * * * *